US008156994B2

(12) United States Patent
Armstrong

(10) Patent No.: US 8,156,994 B2
(45) Date of Patent: Apr. 17, 2012

(54) LONGITUDINAL FRAME MEMBER AND SPLINE

(75) Inventor: Laurence P. Armstrong, Weyerhaeuser, WI (US)

(73) Assignee: FreshAir Screen Technology, LLC, Weyerhaeuser, WI (US)

( * ) Notice: Subject to any disclaimer, the term of this patent is extended or adjusted under 35 U.S.C. 154(b) by 85 days.

(21) Appl. No.: 12/770,929

(22) Filed: Apr. 30, 2010

(65) Prior Publication Data

US 2010/0206364 A1 Aug. 19, 2010

Related U.S. Application Data

(63) Continuation-in-part of application No. 11/760,231, filed on Jun. 8, 2007, now Pat. No. 7,735,540, which is a continuation-in-part of application No. 11/233,640, filed on Sep. 23, 2005, now abandoned, said application No. 11/760,231 is a continuation-in-part of application No. 10/825,525, filed on Apr. 15, 2004, now Pat. No. 7,316,758.

(60) Provisional application No. 60/885,426, filed on Jan. 18, 2007, provisional application No. 60/615,794, filed on Oct. 4, 2004, provisional application No. 60/485,579, filed on Jul. 9, 2003, provisional application No. 60/492,698, filed on Aug. 6, 2003.

(51) Int. Cl.
*E06B 9/24* (2006.01)

(52) U.S. Cl. ..... 160/328; 160/371; 160/127; 136/251; 136/244

(58) Field of Classification Search ..... 160/327, 160/328, 380, 354, 371, 10; 52/222; 24/556, 24/499, 489, 464; 136/244, 251
See application file for complete search history.

(56) References Cited

U.S. PATENT DOCUMENTS

| | | | | |
|---|---|---|---|---|
| 584,148 | A * | 6/1897 | Robinson | 160/381 |
| 875,552 | A | 12/1907 | McGee | |
| 1,235,735 | A | 8/1917 | Steffan et al. | |
| 1,484,382 | A | 2/1924 | Allitt | |
| 2,709,489 | A | 5/1955 | Keebler | |
| 2,784,781 | A | 3/1957 | Rhoades | |
| 3,220,469 | A | 11/1965 | Oehmig | |
| 3,379,237 | A | 4/1968 | Worthington | |
| 3,419,434 | A * | 12/1968 | Colehower | 136/246 |
| 3,552,476 | A | 1/1971 | Le Tarte | |
| 4,232,310 | A * | 11/1980 | Wilson | 340/550 |
| 4,279,061 | A | 7/1981 | Santo | |
| 4,472,862 | A | 9/1984 | Bloomfield et al. | |

(Continued)

OTHER PUBLICATIONS

Office Action for U.S. Appl. No. 11/233,640, Feb. 4, 2008.

(Continued)

*Primary Examiner* — Blair M. Johnson
(74) *Attorney, Agent, or Firm* — Carlson, Gaskey & Olds, P.C.

(57) ABSTRACT

A frame includes longitudinal members secured to one another. The longitudinal members support a spline that is normally open in a first position to provide a cavity. A fabric, such a mesh screen, is arranged over the frame so that the perimeter of the screen is received within the cavities of the longitudinal members. A movable platen is actuated to engage the spline. The splines are forced into the cavities to a second position in which the perimeter of the screen is pinched between the splines and the longitudinal members. A radius nose of the splines is retained in a channel of the longitudinal members securing the screen without tearing it when under load.

17 Claims, 7 Drawing Sheets

U.S. PATENT DOCUMENTS

| | | | | | |
|---|---|---|---|---|---|
| 4,636,579 | A | * | 1/1987 | Hanak et al. | 136/245 |
| 4,662,038 | A | | 5/1987 | Walker | |
| 4,765,039 | A | * | 8/1988 | Rowlands et al. | 24/556 |
| 4,788,806 | A | | 12/1988 | Sease | |
| 4,805,330 | A | | 2/1989 | Bubernak | |
| 4,920,714 | A | | 5/1990 | Sease | |
| 4,986,034 | A | | 1/1991 | Mozuras et al. | |
| 5,039,246 | A | | 8/1991 | Woodruff et al. | |
| 5,232,518 | A | * | 8/1993 | Nath et al. | 136/251 |
| 5,252,141 | A | * | 10/1993 | Inoue et al. | 136/251 |
| 5,380,120 | A | | 1/1995 | Vermeulen | |
| 5,409,549 | A | * | 4/1995 | Mori | 136/244 |
| 5,485,705 | A | | 1/1996 | Guillemet | |
| 6,812,397 | B2 | * | 11/2004 | Lambey | 136/245 |
| 6,945,305 | B1 | | 9/2005 | Limauro | |
| 2011/0168230 | A1 | * | 7/2011 | Buller et al. | 136/244 |

OTHER PUBLICATIONS

Office Action for U.S. Appl. No. 11/233,640, Jul. 9, 2008.

* cited by examiner

LONGITUDINAL FRAME MEMBER AND SPLINE

RELATED APPLICATIONS

This application is a continuation-in-part of application Ser. No. 11/760,231, filed on Jun. 8, 2007 now U.S. Pat. No. 7,735,540, which claims priority to provisional application No. 60/885,426, filed on Jan. 18, 2007. Application Ser. No. 11/760,231, filed Jun. 8, 2007, is also a continuation-in-part of application Ser. No. 11/233,640, filed on Sep. 23, 2005 now abandoned, which claims priority to provisional application No. 60/615,794, filed on Oct. 4, 2004. Application Ser. No. 11/760,231, filed Jun. 8, 2007, is further a continuation-in-part of application Ser. No. 10/825,525, filed on Apr. 15, 2004 now U.S. Pat. No. 7,316,758 which claims the benefit to provisional application Nos. 60/485,579 and 60/492,698 respectively filed on Jul. 9, 2003 and Aug. 6, 2003.

BACKGROUND

This application relates to a longitudinal frame member and spline for use in attaching fabric, for example, to a frame.

Frames used for windows, doors and office furniture, such a cubical dividers, have fabric attached to a frame in some fashion. Other applications include ceiling panels, air/water filter panels, acoustic tiles, etc. In the example of window frames and doors using screens, typically the frame includes longitudinal frame members having channels to which the screen is secured. The longitudinal members are joined to one another in some fashion to provide the frame. During assembly, the screen is positioned over the frame and a rubber spline having a generally circular cross section is inserted into the channels thereby retaining the screen between the spline and longitudinal frame members. Other approaches have been used to secure the screen to the frame. Typically, a separate retaining member is pressed or snapped into the frame, securing the screen between the frame and retaining member. However, manipulating and inserting a separate retaining member, like a rubber or plastic spline into the frame members while controlling the woven fabric, is labor intensive and costly.

Installation of fabric using the spline arrangement described above or other manners of screen attachment are typically labor intensive and costly. In the example of the splines described above, a special tool having rollers must be run along the length of longitudinal member. Moreover, the frame tends to "hourglass" as a result of the screen assembly process. Pre-bowing the frame members and blocking of the assembled frame for squareness is typically used to prevent this undesired result, which adds cost to assembly.

Another approach for securing screens has been to use a hinged retaining member integral with and movable relative to the frame, as disclosed in U.S. Pat. No. 3,379,237. The arrangement disclosed in the '237 patent has at least two problems. First, the frame is not structurally stable such that it will deflect and permit the retaining member to open, thus releasing the screen. Second, the retaining member does not keep sufficient force on the screen to maintain the screen in tension. Third, there is a sharp edge on the retaining member that is the primary and only point of engagement with the screen, which will tend to tear the screen when force is applied to it.

Window and door screens must pass an industry "push out" test. One industry standard requires that the screen be held through the longitudinal frame members for at least forty pounds of applied force. The standard can sometimes be difficult to meet using rubber or plastic splines.

What is needed is an improved frame that requires less labor and cost to manufacture while meeting or exceeding the present industry standard for "push out" and improving the hour glass specifications.

These and other features of the disclosure can be best understood from the following specification and drawings, the following of which is a brief description.

SUMMARY

Figure 2B:
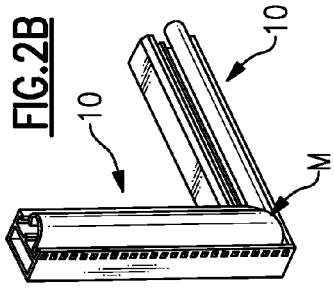
FIG. 2B is a perspective view of the frame of FIG. 2A shown assembled.

An example frame of the disclosure includes longitudinal members secured to one another, for example by using corner locks, to form the frame. The longitudinal members support a spline that is normally open prior to assembly to expose a cavity that receives a fabric. A fabric, such a mesh screen or other flexible membrane, is arranged over the frame so that the perimeter of the screen is received within the cavities of the longitudinal members.

In one example, the splines are forced into the cavities, or channels, to a closed position in which the perimeter of the screen is pinched between a nose of the spline and the longitudinal members.

In another example, the fabric may be a thin film solar cell, and the splines may be adapted to support the thin film solar cell, as well as be in electrical communication therewith. Specifically, the spline may include a conductive strip capable of engaging a conductive foil of the thin film solar cell and transmitting electricity generated by the thin film solar cell to an electrical grid.

The nose provides three engagement features, in one example, that ensure that screen is securely retained without tearing it. The first engagement feature is provided by a curved portion of the nose that engages and pushes the screen down into the cavity as the spline is moved from the open to the closed position. The second engagement features is provided by a corner of the nose that pinches the screen against a base wall of the channel.

Accordingly, the disclosed frame requires less labor and cost to manufacture while meeting or exceeding the present industry standard for "push out." The frame members also do not require pre-bowing or blocking during the assembly process. The frame members may further be adapted to provide sufficient support to a thin film solar cell, and to provide electrical communication between the thin film solar cell and an electrical grid—thus providing an effective and economic alternative to a conventional solar panel.

DETAILED DESCRIPTION

An example longitudinal frame member 10 is shown in the Figures. Like numerals are used to refer to like elements between some Figures.

Referring to FIGS. 1A-2B, a rigid frame is constructed from structure including the longitudinal frame member 10, which provides a tubular portion 12, for example, and a spline 14. The tubular portion 12 is quadrangular in shape in one example. The longitudinal frame member 10 provides a channel 26 that receives a portion of the spline 14 to securely retain the screen to the member 10, which will be discussed in more detail below.

The example member 10 shown in FIGS. 1A-3B is roll formed out of a sheet of metal so that the spline 14 is formed integrally with the longitudinal frame member 10. In other examples, the longitudinal frame member 10 and spline 14 are extruded plastic, aluminum or fiberglass (FIGS. 11A-13). In other examples, the spline 14 can be separately secured to the longitudinal frame member 10, which may be wood or aluminum, to form an integrated structure (FIG. 6), or the plastic spline 14 can be extrused onto the member 10 (FIGS. 14A-15).

Figure 4:
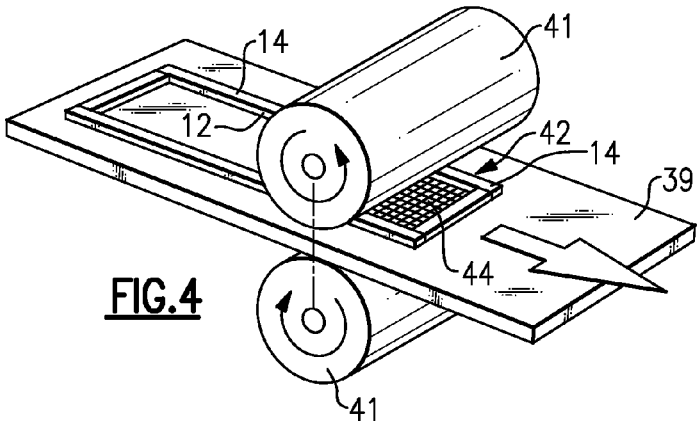
FIG. 4 is a perspective view of another example manufacturing process for the frame.

For roll-formed members, the member 10 includes a first edge 16 provided on the spline 14 and a second edge 18 provided on the tubular portion 12, best seen in FIG. 4. The integral tubular and spline portions 12 and 14 are secured to provide a desired cross-sectional shape by forming a flange 20, which is shown in FIGS. 1A and 4. The flange 20 may include a series of indentations 21 formed by a roller to further secure the metal in the desired shape, best shown in FIG. 1A. In one example, the member 10 is constructed from a suitable metal that is either roll formed and/or extruded. A plastic or other material may also be used.

Opposite the flange 20 is a wall 22 having a slot 24 for receiving a corner lock 28. The corner lock 28 includes first and second legs 30 and 32. The first leg 30 is received in the tubular portion 12, and the leg 32 extends from the slot 24.

Figure 2A:
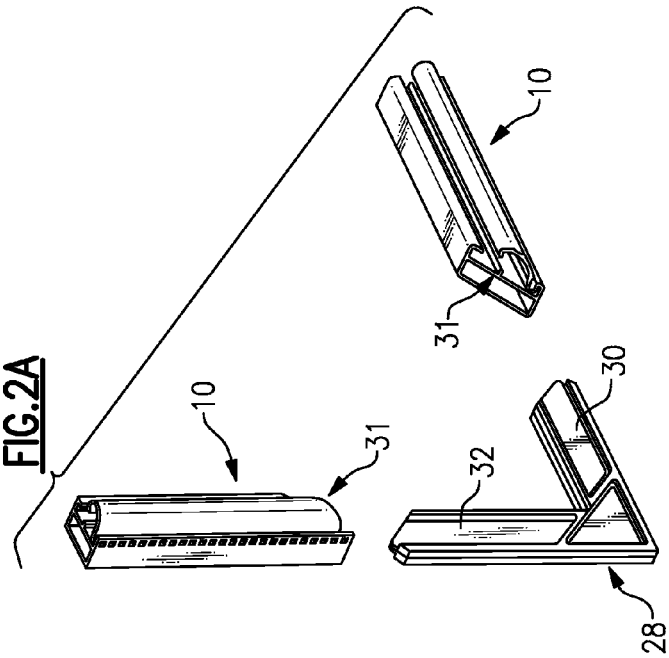
FIG. 2A is an exploded view of a frame including longitudinal frame members with mitered ends.
Figure 1B:
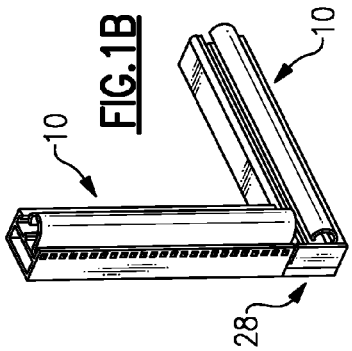
FIG. 1B is a perspective view of the frame of FIG. 1A shown assembled.
Figure 1A:
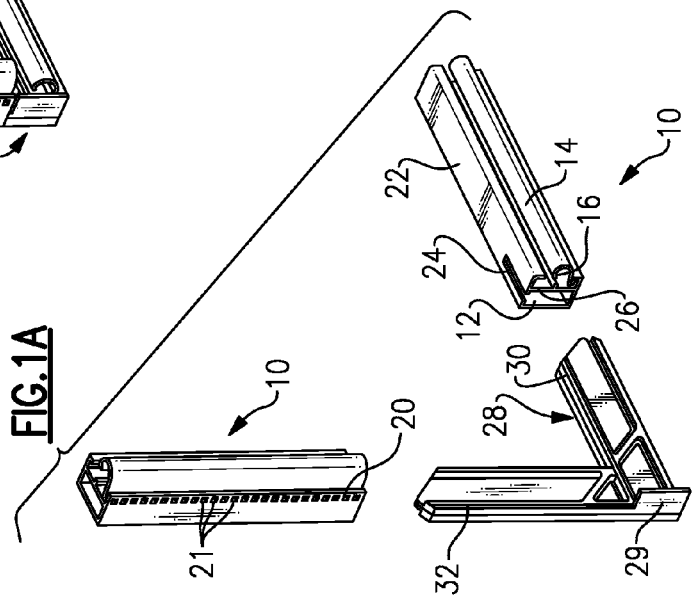
FIG. 1A is an exploded view of a frame including longitudinal frame members with square ends.

The arrangement shown in FIGS. 1A and 1B depicts longitudinal frame members 10 that have square ends. In such an arrangement, it may be desirable to provide an end cap 29 on the corner lock 28. Referring to FIGS. 2A and 2B, the longitudinal frame members 10 include mitered ends 31 that may provide for a more aesthetic mitered joint M and also eliminate the need for slot 24.

Figure 3A:
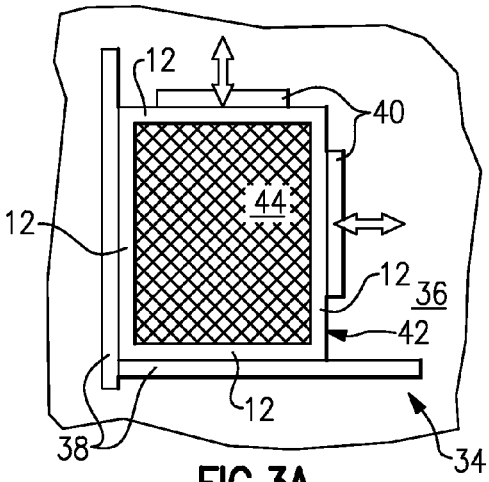
FIG. 3A is a top elevational view of an example manufacturing process for the frame.

Referring to FIG. 3A, a machine 34 is disclosed for securing a fabric 44, such as screen, to be the longitudinal frame members 10. It should be understood that "fabric" is intended to include woven and non-woven materials, which also includes flexible membranes (e.g., thin film solar cells, as described with reference to FIGS. 16A-C, below). The members 10 are assembled using the corner lock 28, for example, or any other suitable method of attachment, to provide a frame 42. The frame 42 is arranged on a fixed platen 36 having fixed stops 38. Movable stops 40 are actuated to secure the frame 42 against the fixed stops 38. The arrangement of stops 38 and 40 enables any size frame 42 to be accommodated on the machine 34.

Another example assembly process is shown in FIG. 4. The frame 42 is supported on a movable surface 39. The surface 39 and frame 42 are passed between opposing rollers 41, which closes the spline 14 over the fabric 44 thus securely retaining the fabric 44 relative to the tubular portion 12.

Figure 3B:
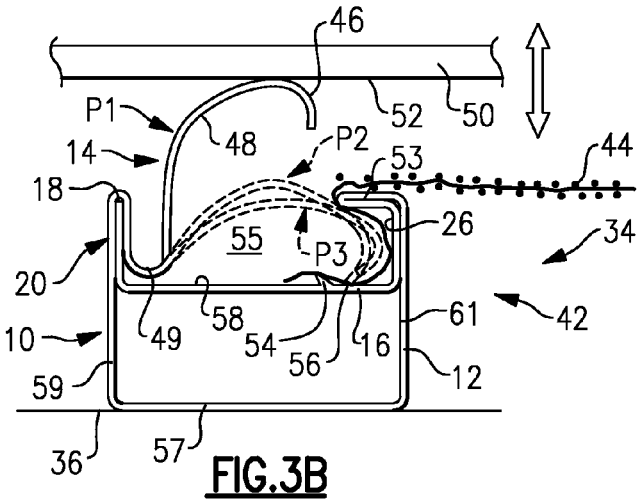
FIG. 3B is a cross-sectional view of the frame having a screen installed.

According to one example method of assembly, referring to FIG. 3B, the fabric 44 is positioned on top of the frame 42 with the spline 14 in a first position P1. A cavity or channel 55 is provided between the spline 14 and the tubular portion 12 in the first position P1 for receiving the fabric 44. The spline portion includes a nose 46 having the first edge 16. The nose 46 extends to an arch 48 having an adjoining spring portion 49 opposite the nose 46. In the example shown in FIG. 3B, the spring portion 49 is integral with the tubular portion 12. In the example embodiment, the nose 46 has a smaller radius than the gradual radius of the arch 48. The spring portion 49 has a smaller radius than the nose 46. The spring portion 49 biases the spline 14 upward and away from the tubular portion 12 to an open position.

The machine 34 includes a movable platen 50 having a flat profile 52. By utilizing a flat profile 52, the tooling costs are drastically reduced since a platen of particular profile requiring machining is not required, and alignment issues between the movable platen 50 and frame 42 are eliminated.

Figure 6:
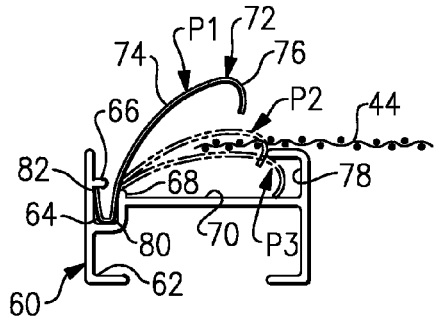
FIG. 6 is a cross-sectional view of another example of the longitudinal frame member.

The tubular portion 12, or base portion, is generally quadrangular in one example and includes a base wall 58 that provides a bottom surface of the channel 26. The base wall 58 extends between and interconnects spaced apart first and second outer walls 59, 61, in one example. In the example shown in FIG. 3B, a bottom wall 57 interconnects the first and second outer walls 59, 61 to provide an enclosed space, which receives the legs 30, 32 of the corner locks 28. The example shown in FIG. 6 depicts a bottom wall 57 with a gap that exposes the space provided by the tubular portion 12. The tubular member provides structural stability to the spline 14 so that it is not forced open once the fabric 44 has been installed. The first outer wall 59 extends outwardly away from the base wall 58 to support the spring portion 49. The second outer wall 61 extends outwardly away from the base wall 58 to provide the flange 53.

The movable platen 50 is moved downward into engagement with the spline 14 moving the spline 14 from the first or open position P1 (see also FIGS. 11A and 11B) to a position which forces the perimeter of the fabric 44 into the channel 26. The curved portion of the nose 46 provided a first engagement feature that pinches the fabric 44 against a flange 53 to stretch the fabric. In one example, the edge of the flange 53 is rounded to prevent the fabric 44 from tearing as the nose 46 pushes the fabric 44 into the channel 26. The arch 48 extends above the flange 53 that, in part, provides the channel 26 along with a surface 58 of the tubular portion 12. The movable platen 50 continues to move downward moving the spline 14 from the second position P2 to the third or closed position P3 (generally represented in FIGS. 3B, 11C and 13). In the position P3, the nose 46 is forced further into the channel 26 (when compared to position P2) securely retaining the perimeter of the fabric 44. The radius nose 46 prevents the fabric 44 from tearing as force is applied to it. The flexible spline 14 deflects without yielding.

The nose 46 has a sharp corner 56, for example, on the first edge 16 that pinches the fabric 44 to retain the perimeter of the screen between the corner 56 and the surface of the base wall 58, thus providing a second engagement feature. The corner 56 not likely to tear the fabric 44 as force is applied to it since the fabric at this location will experience a smaller force that at the first engagement feature. In the third position P3, the arch 48 has a larger radius than it did in first position P1, and the nose 46 has smaller radius than it did in the first position P1. The deflected spline 14 applies sufficient retaining force on the fabric 44 to prevent "push-out" of the fabric. The fabric 44 begins to tear, which occurs at around 125 pounds of applied force for typical insect screen materials, without it pulling out of the channel 26.

Figure 5:
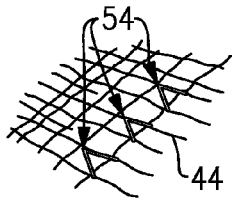
FIG. 5 is a perspective view of barbs used to improve retention of the screen.

To further improve retention of the fabric 44, a third engagement features, such as barbs 54, may extend upward from the base wall 58 into the channel 26, as is show in FIG. 5. The fabric 44 at the third engagement feature experiences an even smaller force than at the second engagement feature.

FIG. 6 depicts another example longitudinal frame member 60, which is extruded. The longitudinal frame member 60 includes a tubular portion 62 having a separate spline portion 72. The tubular portion 62 provides a recess 64 having a protrusion 66 and fulcrum 68. A spring portion 80 of the spline portion 72 is inserted into the recess 64, and an edge 82 is retained by the protrusion 66. The spring portion 80 acts against the fulcrum 68 when moving between the first, second and third positions P1, P2 and P3. Similar to the embodiment described in FIG. 4, the spline portion 72 includes an arch 74 and nose 76. The nose 76 is forced into the channel 78 by the movable platen 50. The fabric 44 is retained between the nose 76 and surface 70.

Figure 8:
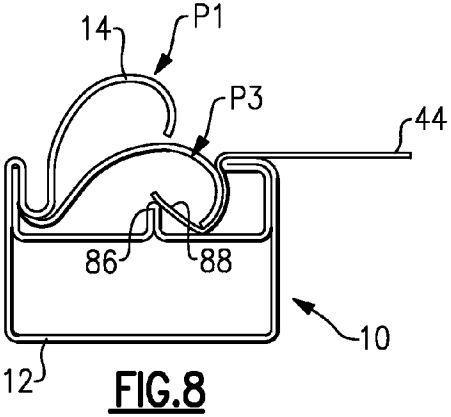
FIG. 8 is a cross-sectional view of a longitudinal frame member similar to FIG. 3B with a ridge.
Figure 7:
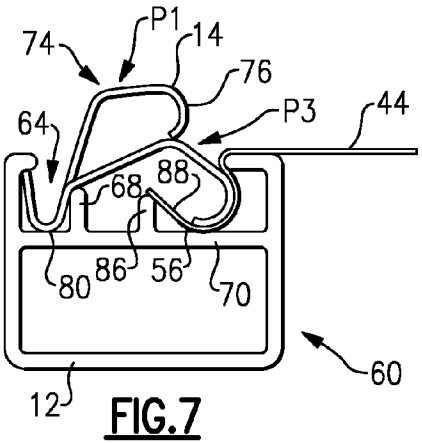
FIG. 7 is a cross-sectional view of a longitudinal frame member similar to FIG. 6 with a ridge.

Referring to FIG. 7, the spring portion 80 is retained in the recess 64. The arch 74 may or may not include an apex, depending upon the geometry of the spline 14 and tubular portion 12. The fulcrum 68 extends from the surface 70. A ridge 86, which provides a third engagement feature, also extends from the surface 70 to lift an edge portion 88 of the fabric 44 away from the surface to better ensure that the corner 56 engages and holds the screen 44. The ridge 86 is also shown for roll-formed longitudinal frame members 10 in FIG. 8, and at 186 and 210 respectively in FIGS. 11B and 14B.

Figure 9:
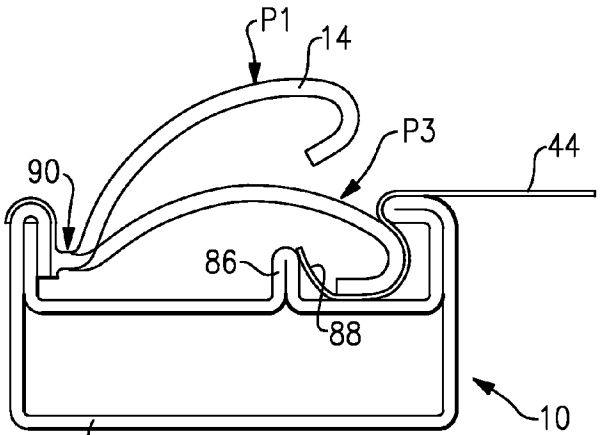
FIG. 9 is a cross-sectional view of a longitudinal frame member similar to FIG. 8 with a spline overmolded to a tubular portion of the frame member.
Figure 11C:
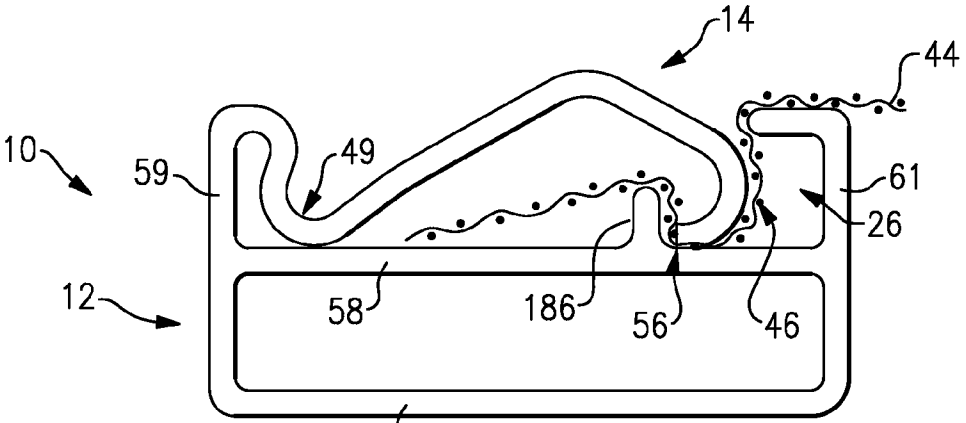
FIG. 11C is a cross-sectional view of the longitudinal frame member shown in FIG. 11B with the spline in a closed or bottomed position.
Figure 11A:
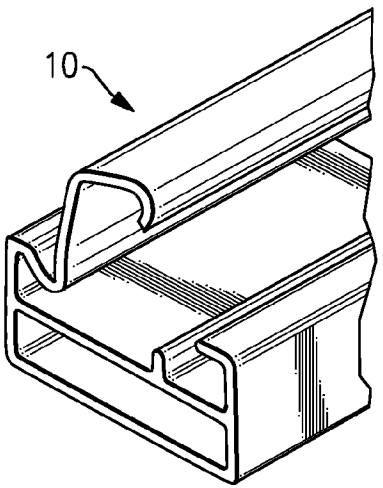
FIG. 11A is a perspective view of another example longitudinal frame member.
Figure 11B:
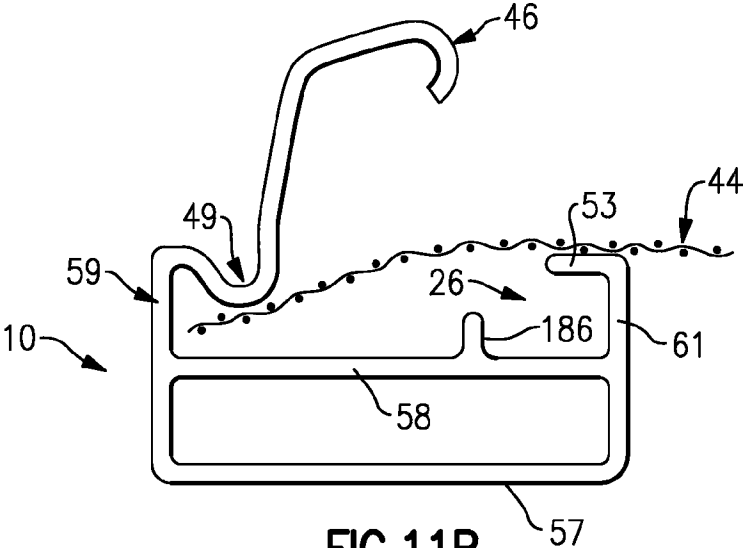
FIG. 11B is a cross-sectional view of the longitudinal frame member shown in FIG. 11A with a screen prior to assembly.
Figure 12:
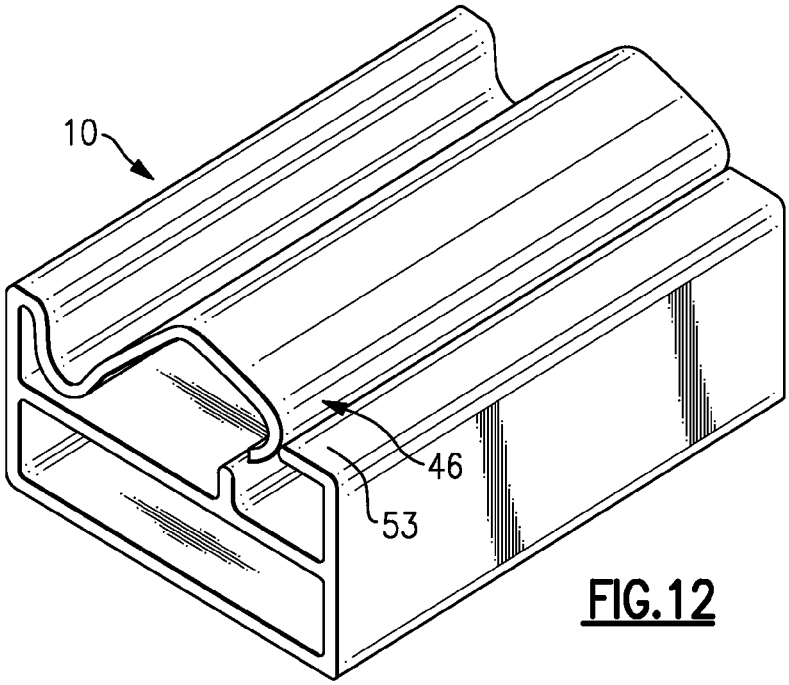
FIG. 12 is a perspective view of the longitudinal frame member shown in FIG. 11A in a transitional or interference position.
Figure 13:
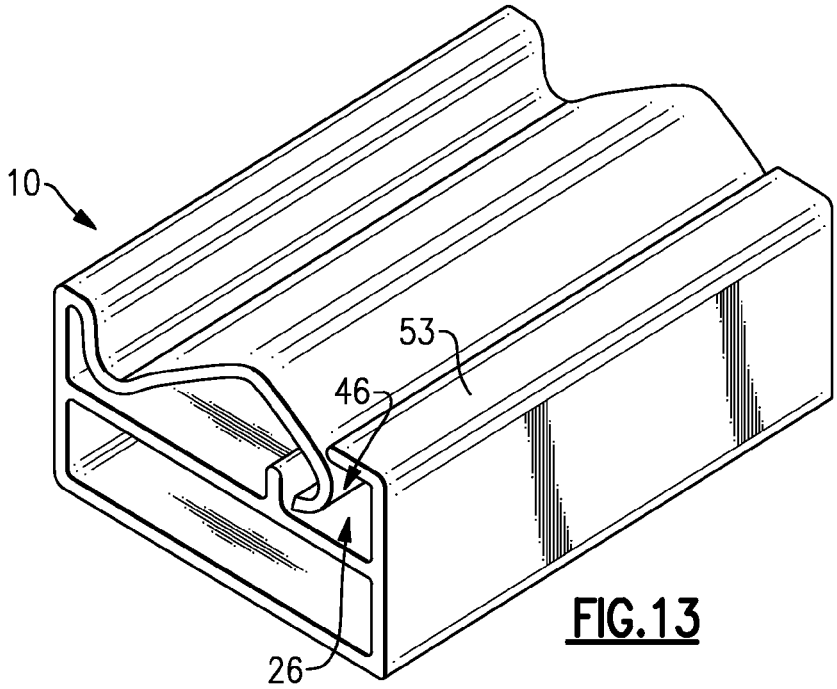
FIG. 13 is a perspective view of the longitudinal frame member shown in FIG. 11C in the closed or bottomed position, but without the screen.

In another example, the spline 14 can be adhered to the tubular portion 12 by any suitable process, such as by laminating or over-molding, as shown in FIG. 9.

The example longitudinal frame member 10 permits easy replacement of the screen. The spline 14 may be "zippered" open and the damaged screen removed and replaced. With the new screen positioned as desired, the spline 14 can be manually forced back into the channel 26 using a block of wood and hammer or a roller, for example.

Figure 10:
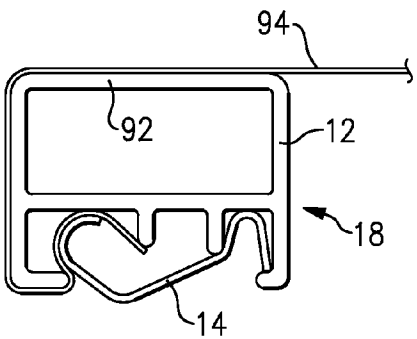
FIG. 10 is a cross-sectional view of the longitudinal frame member wrapped in a decorative fabric.

FIG. 10 depicts the inventive longitudinal frame member 10 for furniture or other applications in which it is desirable to conceal the tubular member 12. A decorative fabric 94 is wrapped around a side 92 other than the side that supports the spline 14. In another example, the member 10 is a sanding block, and the fabric 94 is an abrasive material such as sandpaper or sanding screen. For a sanding block, a spline 14 is provided at each end of the block to retain opposing ends of the sandpaper.

Figure 14B:
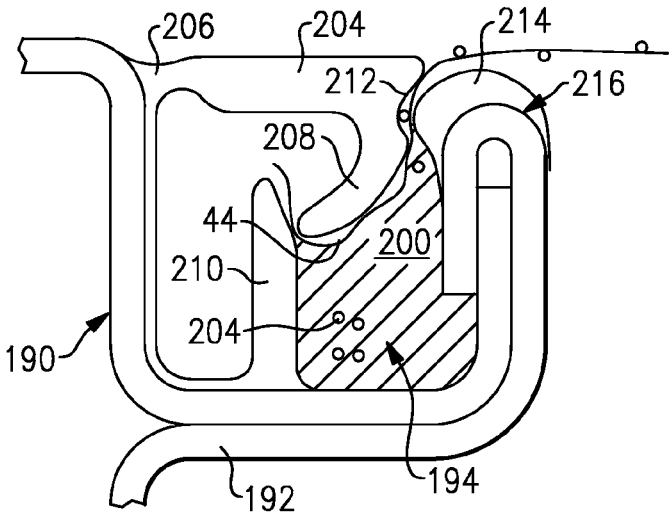
FIG. 14B is a cross-sectional view of a longitudinal frame member shown in FIG. 14A with the spline in a closed position retaining a screen.
Figure 15:
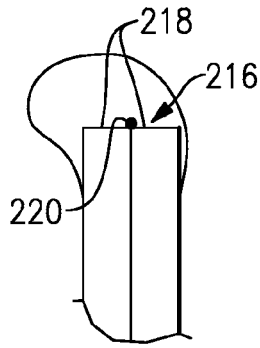
FIG. 15 is an enlarged cross-sectional view of another example construction of an end of the longitudinal frame member.
Figure 14A:
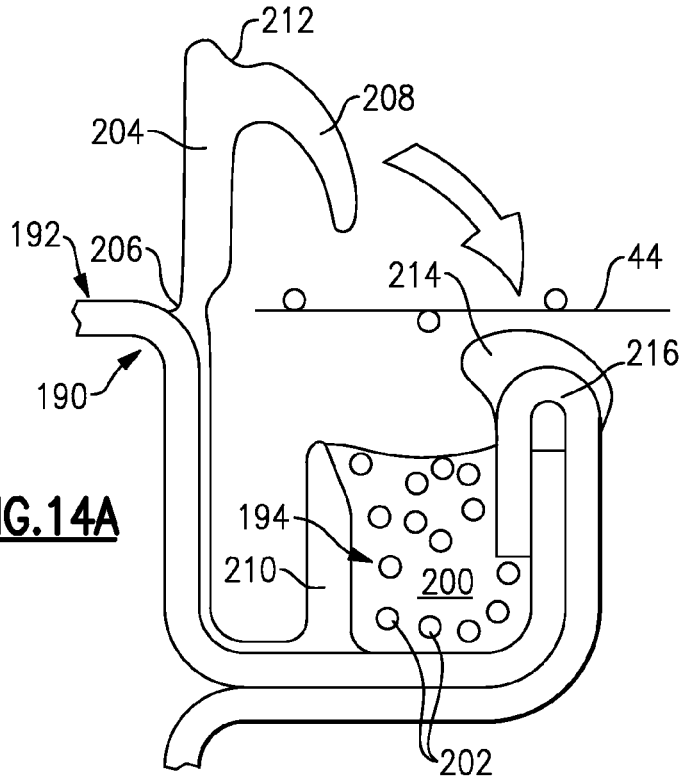
FIG. 14A is a cross-sectional view of a longitudinal frame member with a bi-laminate plastic extrusion spline.

Referring to FIGS. 14A and 14B, the frame 190 includes a frame member 192 having the channel 194. The frame member 192 includes a flange portion having a flange 204 connected to the tubular portion of the frame member 192 by a living hinge 206. The flange 204 includes a hook portion 208 having a recess 212 cooperating with a protrusion 214 arranged on an end 216 of the channel 194. An intermediate wall 210, or ridge, may be arranged in the channel 194 to form a cavity 200 that is filled with adhesive 202. The flange 204, intermediate wall 210, and protrusion 214 are, for example, santoprene molded onto the frame member 192. The edge of the fabric 44 is arranged between the flange 204 and protrusion 214. The flange 204 is forced downward by an upwardly tapering surface 197 of the truck assembly 196. The hook portion 208 positions the edge of the fabric 44 in the adhesive 202, and the fabric 44 is additionally retained between the protrusion 214 and recess 212 of the hook portion 208. Applied heat from the heat source 198 actuates the adhesive 202.

As an alternative configuration to the end 216, edges 218 may be laser welded to one another using a weld bead 222 to form the end 216 shown in FIG. 15.

Figure 16A:
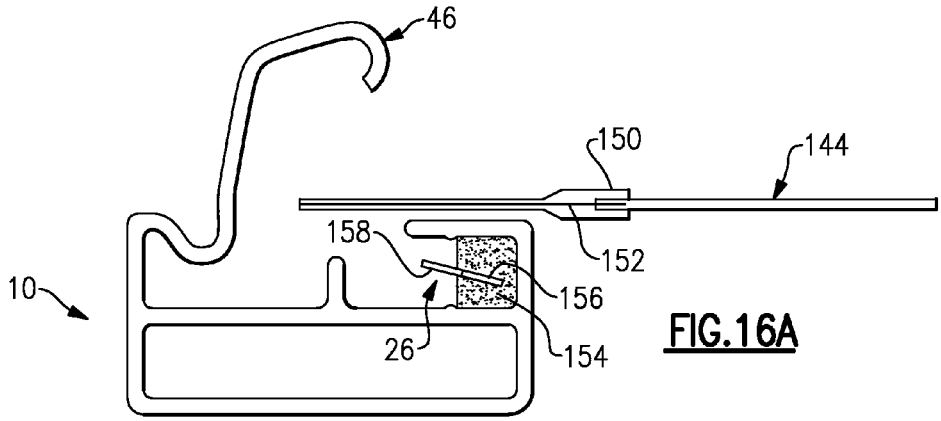
FIG. 16A is a cross-sectional view of another example of the longitudinal frame member shown with a thin film solar cell prior to assembly.
Figure 16B:
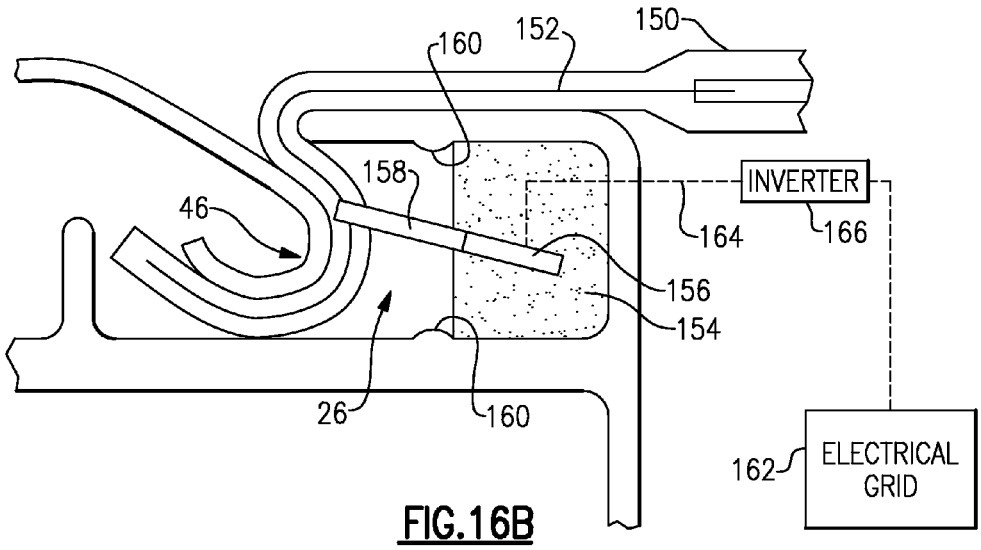
FIG. 16B is an enlarged cross-sectional view of the longitudinal frame member shown in FIG. 16A with the spline in a closed or bottomed position.
Figure 16C:
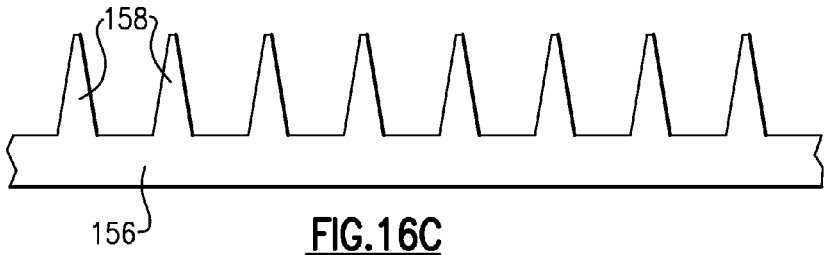
FIG. 16C is a view of the conductive strip shown in FIGS. 16A-16B.

FIGS. 16A-16B are representative of the longitudinal frame member 10 as it is adapted to accommodate a thin film solar cell 144, which may be a thin film photovoltaic (or TFPV) cell. In this context, a thin film solar cell 144 may be any fabric, material, or layer of materials, capable of converting energy from light into electricity. In order to transmit this generated electricity away from the thin film solar cell 144, the longitudinal frame member 10 may include a conductive strip 156 supported within the channel 26 by way of a non-conductive support member 154. The conductive strip 156, or "pickup," is configured to be in electrical communication with the thin film solar cell 144 as well as an electrical grid 162. The electrical grid 162 may be large- or small-scale, and may be a commercial or private electrical grid. The conductive strip 156 may be in communication with the electrical grid 162 by way of a transmission system 164, which may include a DC to AC inverter 166, for example. That is, the output of the thin film solar cell will be in the form of DC, and thus in order for an electrical grid 162 to effectively utilize this electricity, it will likely need to be "inverted" to AC. The transmission system 164 may also be used in conjunction with a "net metering" system (not shown), in which a user's (or commercial entity's) electricity production is compared against their personal use. In some regions, users may obtain credit (e.g., in the form of an electrical bill reduction) for electricity produced in excess of their personal use when that excess electricity is provided to a power company's electrical grid, for example.

As shown, the thin film solar cell 144 may include a nonconductive end portion 150 surrounding a conductive foil 152. The conductive foil 152 is used to transmit electricity generated by the thin film solar cell 144 to the conductive strip 156 by way of teeth 158 (shown in detail in FIG. 16C) capable of penetrating the nonconductive end portion 150. Specifically, as shown in FIG. 16B, when the spline 46 of the longitudinal frame member 10 is in the closed position, the thin film solar cell 144 is brought into engagement with the teeth 158 such that the teeth 158 penetrate the nonconductive end portion 150 and are brought into electrical communication with the conductive foil 152—thereby electrically linking the thin film solar cell 144 with the conductive strip 156. In this manner, the longitudinal frame member 10 provides sufficient support to the thin film solar cell 144 (e.g., such that the thin film solar cell 144 has little, or no, sagging), and also provides an effective electrical link between the thin film solar cell 144 and an electrical grid 162.

Several frame members 10 may accommodate respective thin film solar cells 144, and these frame member-thin film solar cell combinations may be arranged in series (or "daisy-chained") in order to effectively transmit electricity to the electrical grid 162.

The conductive strip 156 may be made of copper, but the conductive strip 156 may also be made of any material sufficient to penetrate the nonconductive end portion 150 (which may be made of polypropylene or another nonconductive plastic material) while still effectively transmitting electricity from the conductive foil 152 (which may be a copper foil) to an electrical grid 162. As explained above, the frame member 10 may be made of metal (e.g., steel, aluminum, etc.) or other suitable materials (e.g., plastics, etc). Notably, if the frame member 10 is made of a conductive material such as metal, the conductive strip 156 must be insulated from the frame 10 by way of the nonconductive support member 154.

Known manufacturing methods may be utilized to adapt the longitudinal frame member 10 for use with the thin film solar cells 144 in the manner described. For example, the nonconductive end portion 150 may be sonically welded to respective ends of the thin film solar cell 144. Further, the nonconductive support member 154 may be retained in the channel 26 by way of protrusions 160 (as shown in FIGS. 16A-B), however other retaining methods, may be utilized.

In one method, the nonconductive support member 154 and the frame member 10 may be formed as a single, bilaminate member with a continuous profile. In forming the nonconductive support member 154 and the frame member 10 into a bilaminate, the frame member 10 may be made of one material (for example, a metal or rigid plastic), and the nonconductive support member 154 may be made of another material (for example, a plastic or other non-conductive material) which is bonded to the frame member 10 by way of a thin, extruded layer of polypropylene. In one example, a metallic frame member 10 is roll-formed and fed through a crosshead extrusion die. Various plastics (including the thin, extruded layer of polypropylene, and the plastic that will ultimately take the form of the nonconductive support member 154) may be injected into the crosshead extrusion die contemporaneous with the frame member 10 being fed through the die. By virtue of the configuration of the crosshead extrusion die, the plastics will bond with the metallic frame member 10, and take the form of the cross-head extrusion die, thereby providing single, bilaminate frame member 10. In this manner, the frame member 10 and the nonconductive support member 154 may be made of different materials, but they will exhibit a single profile without compromising their respective functions (e.g., the frame will still be rigid, and the nonconductive support member will still be nonconductive and will insulate the frame). The resultant profile will be similar to that shown in FIG. 16*c*, however there would appear to be no difference between the nonconductive support member 154 and the frame member 10, and the protrusions 160 would no longer be needed.

The example embodiments have been described in an illustrative manner, and it is to be understood that the terminology that has been used is intended to be in the nature of words of description rather than of limitation. Many modifications and variations of the disclosed examples are possible in light of the above teachings. For that reason, the following claims should be studied to determine their true scope and content.

What is claimed is:

1. A frame for supporting a fabric comprising:

a fabric;

a longitudinal member including a base wall, a first outer wall, a flange projecting from the first outer wall, a channel formed between the base wall and the flange, and a spline pivotally attached about a pivot, the pivot being located opposite the channel, and the spline including a radius nose and an arch extending between the radius nose and the pivot;

wherein the spline is configured to pivot between an open position and a closed position;

wherein, when the spline is in the closed position, the spline is positioned within the channel and the fabric is pinched between the radius nose and the base wall;

wherein, when the spline is in the closed position, the radius nose moves in response to an application of a downward force to the arch; and wherein the fabric is a thin film solar cell.

2. The frame according to claim 1, wherein the frame further includes a conductive strip positioned within the channel, the conductive strip being in electrical communication with the thin film solar cell.

3. The frame according to claim 2, wherein the conductive strip includes a plurality of teeth, the teeth protruding into an end of the thin film solar cell.

4. The frame according to claim 2 wherein a nonconductive support member supports the conductive strip in the channel.

5. The frame according to claim 4 wherein the nonconductive support member and the longitudinal member are formed as a bilaminate member.

6. The frame according to claim 1 wherein, when the spline is in the open position, the radius nose is spaced from the channel.

7. The frame according to claim 1, wherein the longitudinal member and spline are provided by a single extruded member.

8. The frame according to claim 1, wherein the radius nose includes a curved portion and a corner, the curved portion being arranged near the flange to provide a first engagement feature, and the corner being arranged near the base wall to provide a second engagement feature, the fabric being stretched by the radius nose between the first and second engagement features.

9. The frame according to claim 1, wherein the spline includes a U-shaped spring portion that provides a fulcrum about which the radius nose pivots between the open and closed positions.

10. The frame according to claim 1, wherein the arch and radius nose provide a generally C-shaped unitary member, and wherein the arch includes a curved apex protruding away from the longitudinal member.

11. A structure for supporting a fabric comprising:

a longitudinally extending member including a channel, the channel provided between a surface and a flange spaced from the surface; and a spline pivotably attached to the longitudinally extending member at a location opposite the flange, the spline configured to be positioned in a first position in which the spline is spaced from the flange, the spline including an arch and a nose, the arch extending from the location opposite the flange and having a first concave surface defined by a first radius in the first position, the nose extending from the arch and having a second concave surface defined by a second radius in the first position;

wherein the first and second radii are different sizes, and the first and second concave surfaces face the channel;

wherein, when the spline is in a second position in which the spline is received within the channel, the nose is retained in the channel and engages the surface, and at least one of the arch and the nose engages the flange; and wherein the structure supports a thin film solar cell, and wherein the structure is configured to communicate electricity generated by the thin film solar cell to an electrical grid.

12. The structure of claim 11 wherein, when in the second position, the nose is in contact with the surface by way of the thin film solar cell, and the at least one of the arch and the nose is in contact with the flange by way of the thin film solar cell.

13. The structure of claim 11 wherein the radius of the arch is larger when the spline is in the second position than when the spline is in the first position, and the radius of the nose is smaller when the spline is in the second position than when the spline is in the first position.

14. A system for supporting a thin film solar cell comprising:

a structure including a channel and a flexible protrusion member;

a non-conductive support member supported within the channel, a conductive strip protruding from the non-conductive support member;

a thin film solar cell including a conductive end member; and wherein the flexible protrusion member is configured to retain the conductive end member against the conductive strip such that the conductive end member and the conductive strip are in electrical communication with one another.

15. The system of claim 14 wherein the conductive strip is in communication with an electrical grid by way of an electrical transmission system.

16. The system of claim 14 wherein the conductive strip and the conductive end member are each made of copper.

17. The system of claim 14 wherein the flexible protrusion member is a spline member pivotally attached to the structure.

* * * * *